United States Patent [19]

Kakaris

[11] 4,291,933

[45] Sep. 29, 1981

[54] ELECTRICAL CONNECTOR HAVING IMPROVED NON-DECOUPLING MECHANISM

[75] Inventor: Aristotelis Kakaris, Chicago, Ill.

[73] Assignee: Akzona Incorporated, Asheville, N.C.

[21] Appl. No.: 120,457

[22] Filed: Feb. 11, 1980

[51] Int. Cl.[3] ..... H01R 13/62

[52] U.S. Cl. ..... 339/89 R; 339/DIG. 2

[58] Field of Search ..... 339/89, 90, DIG. 2; 285/82, 87, 89; 151/25

[56] References Cited

U.S. PATENT DOCUMENTS

| | | | |
|---|---|---|---|
| 1,076,674 | 10/1913 | Jacobs | 151/25 A |
| 3,343,852 | 9/1967 | Blight et al. | 339/DIG. 2 |
| 3,587,032 | 6/1971 | Normann | 339/DIG. 2 |
| 4,109,990 | 8/1978 | Waldron et al. | 339/113 R |
| 4,239,314 | 12/1980 | Anderson et al. | 339/89 M |

*Primary Examiner*—John McQuade

*Attorney, Agent, or Firm*—Francis W. Young; David M. Carter

[57] ABSTRACT

There is provided an electrical connector including a plug and receptacle and a coupling nut to secure the connection between the plug and receptacle. In order to prevent loosening of the connection, particularly during vibration, a non-decoupling mechanism is provided. The non-decoupling mechanism includes a series of ratchet teeth disposed about the outer perimeter of the plug, and a curved spring sector, which is housed in the coupling nut and includes a fingertip bent inwardly to make contact with the ratchet teeth. The fingertip and ratchet mechanisms are constructed so that the coupling nut moves more easily in the tightening direction than the loosening direction, thus, during vibration, the connector will not tend to loosen.

5 Claims, 7 Drawing Figures

ELECTRICAL CONNECTOR HAVING IMPROVED NON-DECOUPLING MECHANISM

BACKGROUND OF THE INVENTION

This invention relates to electrical connectors. More particularly, it relates to electrical connectors having non-decoupling mechanisms.

Electrical connectors used in high vibration situations, such as in aircraft, have been plagued with a problem of decoupling, or coming apart, during use. This is particularly a problem in cylindrical type connectors, which utilize coupling nuts to maintain the connection between the plug and the receptacle. Several non-decoupling mechanisms, which are attached to portions of the coupling nut, and either the plug or receptacle have been provided as attempts to overcome their problems.

Several of these devices are described in U.S. Pat. Nos. 3,971,614 and 4,030,798, both assigned to Akzona, Inc., assignee of the present invention. Each of these two patented devices use ratchet teeth on the side of the coupling nut adapted to engage spring fingers which are affixed to the outer cylindrical body of either the plug or the receptacle.

Another non-decoupling system is shown in U.S. Pat. No. 4,152,039, also assigned to Akzona, Inc. The connector shown in this patent is normally made from plastic and utilizes a series of spaced apart ratchets about the outer periphery surface of either the plug or the receptacle. The coupling nut has plastic spring members integral therewith about its inner periphery surface to engage these ratchets on the body of the connector. This design is similar to the connector shown in U.S. Pat. No. 4,109,990, wherein a straight spring member is connected to the coupling nut inner periphery surface. A dimple extends from the bottom of the spring and is adapted to engage ratchet teeth of different steepnesses to provide the non-decoupling function. However, this device has been found to have many drawbacks, particularly when it is needed to vary the coupling and decoupling torque of the connector. Furthermore, this connector is difficult to manufacture and positive contact between the ratchet valleys and the dimple is often difficult to maintain.

Another non-decoupling mechanism is shown in U.S. Pat. No. 3,594,700, which is also assigned to Akzona, Inc. This patent shows a connector having ratchet teeth on the inner surface of the coupling nut, and a spring member connected to the body of the connector, with a protruding portion adapted to contact the ratchet teech. Other electrical connectors which have non-decoupling mechanisms are also shown in U.S. Pat. Nos. 3,611,260 and 3,517,371.

In areas outside the electrical connector art, there are nut locks, examples of which are shown in U.S. Pat. Nos. 718,336; 957,504 and 1,001,871, all having non-decoupling mechanism which utilizes ratchets on a nut with a washer having a spring mechanism to ride over the ratchets.

Even with all of the above cited prior art, there remains a need for a easy to manufacture and assemble, and highly reliable non-decoupling mechanism for electrical connectors.

OBJECTS OF THE INVENTION

It is one object of this invention to provide an improved non-decoupling mechanism for electrical connectors.

It is another object to provide an easy to manufacture and assemble non-decoupling mechanism for electrical connectors.

It is still another object to provide a simple and reliable non-decoupling mechanism in electrical connectors where the torque on its coupling nut is higher in one direction than the other.

SUMMARY OF THE INVENTION

In accordance with one form of this invention, there is provided an electrical connector including at least one cylindrical shell receiving an insert. The insert is adapted to receive at least one electrical contact. The shell includes a plurality of ratchet teeth which project circumferentially from the outer surface of the shell. A coupling nut is adapted to engage the cylindrical shell and a corresponding member matable with the cylindrical shell. A curved slot is provided on the inside of the coupling nut and receives and retains a spring sector therein. The spring sector includes a curved portion, which fits into the curved slot, and it further includes a spring finger bent inwardly from the curved portion having a free end engaging the ratchet teeth as the coupling nut is rotated. The spring finger and ratchet teeth arrangement provides for less torque as the free end is pulled across the ratchet teeth than when the free end is pushed across the ratchet teeth.

BRIEF DESCRIPTION OF THE DRAWINGS

The subject matter which is regarded is set forth in the appended claims. The invention itself, however, together with further objects and advantages thereof, may be better understood with reference to the following description taken in conjunction with the accompanying drawings in which:

DESCRIPTION OF THE PREFERRED EMBODIMENT

Figure 1:
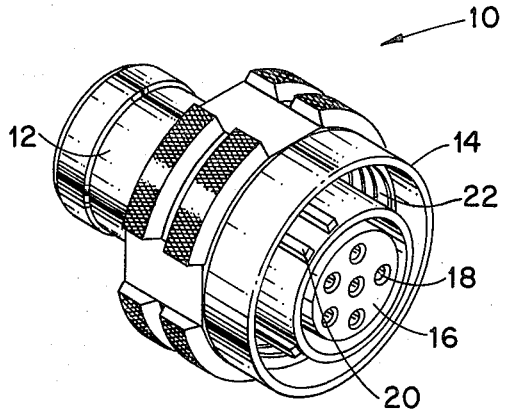
FIG. 1 is a pictorial view of an electrical connector for which the subject invention is particularly useful.

FIG. 1 shows electrical connector 10, which includes cylindrical shell 12 and coupling nut 14. In this embodiment, the cylindrical shell is a plug shell. Plug 12 is adapted to mate with a corresponding receptacle (not shown) or some other matable member. Within shell 12 is insert 16, which includes a plurality of holes 18, each adapted to receive an electrical contact. The insert is normally made of an electrically insulating material, such as a ceramic, plastic or rubber. The body of the shell 12 includes several longitudinal raised portions 20 which act as keys to be received in corresponding receptacle recessed keys so that the contacts are properly aligned. The coupling nut is mounted on a shoulder (not shown in FIG. 1) on the outer circumferential body of the shell 12 and includes threads 22 which are adapted to engage with corresponding threads on the plug which is to be mated to the receptacle.

Figure 2:
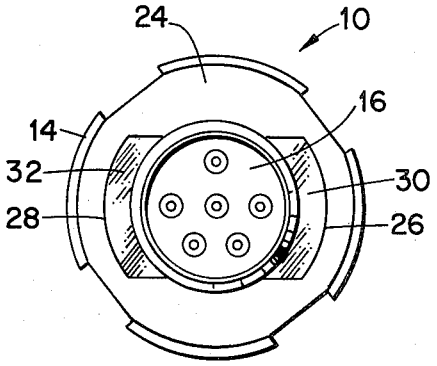
FIG. 2 is an end view of the electrical connector of FIG. 1.
Figure 3:
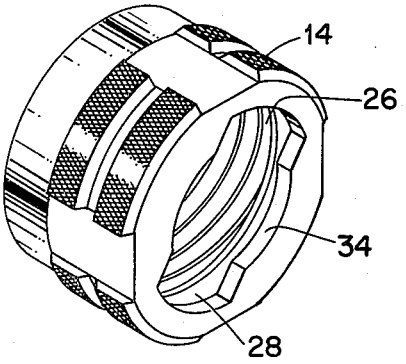
FIG. 3 is a pictorial view of the coupling nut shown in FIG. 1.

FIG. 2 shows the other end of the plug and coupling nut 10. The coupling nut includes the solid facing 24 and a pair of curved slots 26 and 28, which receive curved spring sectors 30 and 32, which are identical spring sectors and are shown better in the pictorial representation in FIG. 5. These slots 26 and 28, however, may be better seen in reference to FIG. 3, which is a pictorial view of the coupling nut. The barrel of the cylinder plug shell is adapted to be received in the circular hole 34 of the coupling nut. As can be seen, the slots 26 and 28 are curved and for receiving the curved spring sector shown in FIG. 5 by merely dropping the spring sectors into the slots. Thus, the spring sector is very easy to assemble with the coupling nut.

Figure 4:
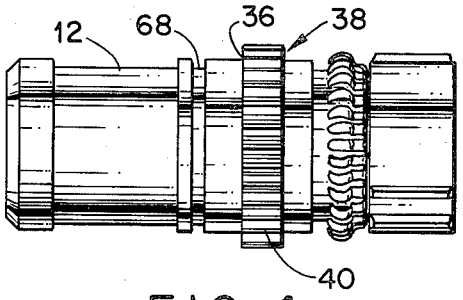
FIG. 4 is a side view of the connector body, in this case, a plug of the electrical connector of FIG. 1 showing the coupling nut removed.

FIG. 4 shows a side view of the cylindrical plug shell, over which rides the coupling nut 14. The inside of the front face 24 of the coupling nut abuts against the shoulder 36 of raised portion 38 which extends circumferentially about the barrel of the cylindrical plug, thus retaining the coupling nut in one axial direction. This raised annular portion 38 also forms ratchet teeth 40 over which rides the fingertip 42 of spring sector 30. The fingertip and the ratchet teeth cooperate with one another to provide the non-decoupling features as described herein, as particularly shown in FIGS. 5, 6 and 7.

Figure 5:
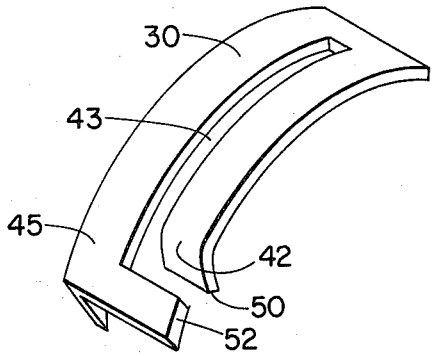
FIG. 5 is a pictorial view of a spring sector that is to be fitted into the slot in the coupling nut shown in FIG. 3.
Figure 6:
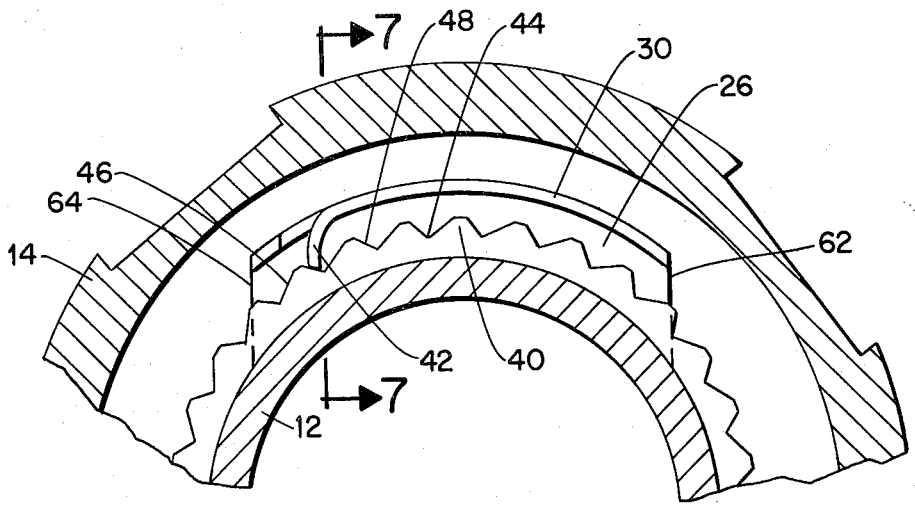
FIG. 6 is a partial front view of the other side of the electrical connector of FIG. 1 showing the spring sector-ratchet arrangement.

As can be seen from FIG. 6, the curved spring sector 30 is fitted into slot 26 or 28 of coupling nut 14, and with the fingertip projecting down and onto the ratchet teeth 40, rides over the tops and into the valleys of the adjacent ratchet teeth. The steepness of the ramps on each ratchet tooth are different; that is, for example, ratchet tooth 44 includes a very steep ramp 48 and a less steep ramp 46. This feature will held enable the coupling nut to turn easier in one direction, that is, easier up the less steep ramp than the more steep one. The direction of turning across the less steep ramps is in the tightening direction of the coupling nut. However, in order to enhance this non-decoupling feature, the end advantage is taken of the differential in spring force created by pushing the finger up a ramp as opposed to pulling it across a ramp. This is because the spring compression is greater when one tries to compress the spring inwardly than when one tries to compress the spring upwardly. Thus, the spring and ratchet system described herein not only utilizes the differentials in steepnesses of the ramp of the ratchets, but also the spring pressure differentials in the spring sector itself. Axial shoulder 52, as shown in FIG. 5, permits the finger top 42 to operate freely in the connector. Slit 43 provides a space between curved portion 45 and the finger tip, so that the spring tip would not tend to jam up in the coupling and decoupling modes.

Figure 7:
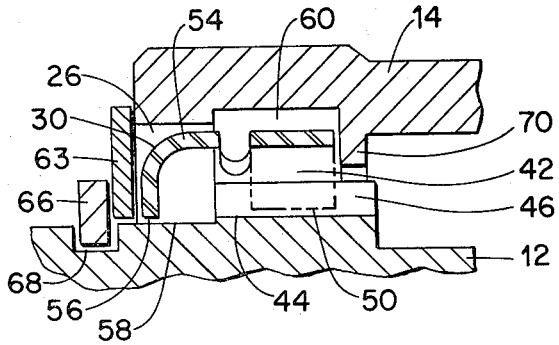
FIG. 7 is a cross sectional taken through section 7—7 of the connector shown in FIG. 6.

The interrelationship between the spring sector, the coupling nut and the plug body may be better seen in reference to FIG. 7, which is a cross-sectional view taken through section line 7—7 of FIG. 6. As can be seen, the body portion 54 of spring sector 30 is received in slot 26 of the coupling nut. The curved end portion of the body of the spring sector indicated at 56 will contact the curved portion 58 of the cylindrical shell. The finger 42 is received, in this embodiment, in a circumferential slot 60 in the coupling nut. As shown in FIG. 6, it is the ends of 62 and 64 of slot 26 that retain the spring sector in the circumferential direction. As can be seen, the end 50 of finger 42 engages ramp 48 of ratchet tooth 44. Washer 63 abuts against the end of the coupling nut, and permits it to rotate freely while retaining ring 66 rests in groove 68, and retains the washer, as well as the coupling nut itself from sliding off of the receptacle body. Washer 63 also retains the spring sector 30 from falling out of the slot 26 in the backward axial direction. Shoulder 70 retains the spring sector in the forward axial direction.

From the foregoing description of the preferred embodiment of the invention, it will be apparent that many modifications may be made therein. It will be understood, however, that this embodiment is intended as an exemplification of the invention only, and that the invention is not limited thereto. It should be understood, therefore, that it is intended in the appended claims to cover all modifications that fall within the true spirit and scope of the invention.

I claim:

1. An electrical connector comprising:

a cylindrical shell receiving an insert, said insert receiving at least one electrical contact, said shell including a plurality of ratchet teeth projecting from the outer surface of said shell; a coupling nut adapted to engage said cylindrical shell and a corresponding member matable with said cylindrical shell; a spring sector; a curved slot in the inside of said coupling nut for retaining said spring sector, said spring sector including a curved portion having opposing ends adapted to abut against the walls of said curved slot, and further including a spring finger bent inwardly from said curved portion, said finger including a free end, said free end engaging said ratchet teeth as said coupling nut is rotated, said spring finger providing less torque as said free end is pulled across said ratchet teeth than when said free end is pushed across said ratchet teeth, whereby said coupling nut will more easily rotate in one direction than the other.

2. An electrical connector as set forth in claim 1, wherein said ratchet teeth include ramps of unequal angles with respect to the surface of said cylindrical shell.

3. An electrical connector as set forth in claim 1, wherein said spring sector includes a main body portion a slot being between main body portion and said spring finger to prevent binding of said spring finger.

4. An electrical connector as set forth in claim 1, wherein said spring sector further includes an axial shoulder projecting in front of said spring finger.

5. An electrical connector comprising:

a cylindrical shell receiving an insert, said insert receiving at least one electrical contact, said shell including a plurality of ratchet teeth projecting from the outer surface of said shell, each ratchet tooth including ramps having different angles with respect to the surface of said cylindrical shell; a coupling nut adapted to engage said cylindrical shell and a corresponding member matable to said cylindrical shell; a spring sector; a curved slot in the inside of said coupling nut for retaining said spring sector in the circumferential direction, said spring sector including a curved portion having opposing ends adapted to abut against the walls of said curved slot, and further including a spring finger bent inwardly from said curved portion; a slot being between said curved portion and said finger to prevent binding of said spring finger, said spring finger including a free end engaging said ramps of said ratchet teeth as said coupling nut is rotated; an axial shoulder projecting in front of said spring finger from the curved portion of said spring sector; said spring finger providing less torque as said free end is pulled across said ratchet teeth than when said free end is pushed across said ratchet teeth, whereby said coupling nut will turn easier in one direction than the other.

* * * * *